US007340926B2

(12) United States Patent
Kim et al.

(10) Patent No.: US 7,340,926 B2
(45) Date of Patent: Mar. 11, 2008

(54) RESTRAINT DEVICE

(76) Inventors: Keun J. Kim, 6823 Union Mill Rd., Clifton, VA (US) 20124; Kay K. Kim, 6823 Union Mill Rd., Clifton, VA (US) 20124

( * ) Notice: Subject to any disclaimer, the term of this patent is extended or adjusted under 35 U.S.C. 154(b) by 222 days.

(21) Appl. No.: 11/258,029

(22) Filed: Oct. 26, 2005

(65) Prior Publication Data

US 2006/0272366 A1 Dec. 7, 2006

Related U.S. Application Data

(63) Continuation-in-part of application No. 11/143,284, filed on Jun. 3, 2005, now abandoned.

(51) Int. Cl.
*E05B 75/00* (2006.01)

(52) U.S. Cl. ..... 70/16; 70/15; 128/878; 128/879

(58) Field of Classification Search ..... 70/15–17, 70/30, 49; 128/878, 879, 869; 119/770, 119/792, 794, 796, 818, 819
See application file for complete search history.

(56) References Cited

U.S. PATENT DOCUMENTS

| | | | | | |
|---|---|---|---|---|---|
| 153,312 | A | * | 7/1874 | Broome | 70/16 |
| 372,510 | A | * | 11/1887 | Bean | 70/16 |
| 381,005 | A | * | 4/1888 | Fergusson | 70/16 |
| 539,650 | A | * | 5/1895 | Ferrell | 70/16 |
| 643,956 | A | * | 2/1900 | Searle | 70/47 |
| 711,778 | A | * | 10/1902 | Mealer | 70/16 |
| 1,477,777 | A | * | 12/1923 | Shek | 70/38 C |
| 3,693,596 | A | * | 9/1972 | Croce et al. | 119/796 |
| 3,906,758 | A | * | 9/1975 | Hurwitt | 70/30 |
| 3,937,418 | A | * | 2/1976 | Critelli | 242/384.7 |
| 4,024,736 | A | * | 5/1977 | De Michieli | 70/16 |
| 4,086,795 | A | * | 5/1978 | Foster et al. | 70/233 |
| 4,122,587 | A | * | 10/1978 | Weiss et al. | 5/621 |
| 4,756,171 | A | * | 7/1988 | Homar | 70/18 |
| 4,846,527 | A | * | 7/1989 | Julien et al. | 297/411.36 |
| 4,896,517 | A | * | 1/1990 | Ling | 70/18 |
| 4,964,370 | A | * | 10/1990 | Peterson | 119/794 |
| 5,144,821 | A | * | 9/1992 | Ernesti et al. | 70/159 |
| 5,156,028 | A | * | 10/1992 | Jiang | 70/30 |
| 5,377,626 | A | * | 1/1995 | Kilsby et al. | 119/796 |
| 5,492,285 | A | * | 2/1996 | Hamrick | 242/379 |
| 5,722,266 | A | * | 3/1998 | Yeager et al. | 70/57 |
| 5,768,920 | A | * | 6/1998 | DeBevoise | 70/18 |
| 6,026,661 | A | * | 2/2000 | Spiropoulos | 70/16 |

(Continued)

*Primary Examiner*—Suzanne Dino Barrett

(57) ABSTRACT

Restraint devices which have a first bracelet, a second bracelet, and a central holder. In one embodiment, the central holder contains a one-way locking mechanism and a retraction/extension mechanism. In a second embodiment, the central holder comprises a retraction/extension mechanism. One end of a line is attached to the second bracelet and the other end of the line is attached to the retraction/extension mechanism, which urges the second bracelet toward the central holder. When the first bracelet is open, the line may be extended from the central holder or retracted to the central holder. When the first bracelet is closed, the retraction/extension mechanism is engaged, causing the one way locking mechanism/one way clutch to allow retraction of the bracelet toward the central holder, but to prevent extension of the bracelet away from the central holder. A line stopper is disclosed which connects with the line between the retraction/extension mechanism and the second bracelet.

4 Claims, 6 Drawing Sheets

U.S. PATENT DOCUMENTS 6,263,710 B1 * 7/2001 Harris ..... 70/16
6,334,444 B1 * 1/2002 Sisco ..... 128/869
6,360,747 B1 * 3/2002 Velarde et al. ..... 128/869
6,672,310 B1 * 1/2004 Streeter et al. ..... 128/869
6,718,984 B2 * 4/2004 O'Shea ..... 128/846
7,210,317 B2 * 5/2007 Beane et al. ..... 70/16
2005/0039499 A1 * 2/2005 Didomenico ..... 70/16
2007/0180870 A1 * 8/2007 DePetrillo ..... 70/16

* cited by examiner

4

RESTRAINT DEVICE

CROSS-REFERENCE TO RELATED APPLICATIONS

This application is a continuation-in-part of application Ser. No. 11/143,284, filed Jun. 3, 2005 now abandoned.

STATEMENT REGARDING FEDERALLY SPONSORED RESEARCH OR DEVELOPMENT (Not applicable)

REFERENCE TO SEQUENTIAL LISTING, A TABLE, OR A COMPUTER PROGRAM LISTING APPENDIX SUBMITTED ON A COMPACT DISC (Not applicable)

BACKGROUND OF THE INVENTION

1) Field of the Invention

This invention relates to restraining systems. More particularly, this invention relates to restraining systems such as handcuffs or shackles which may be applied to a subject while the hands or feet are far apart and, once locked, the distance between the bracelets of the restraining systems may decrease, but cannot increase.

2) Description of the Related Art

It is known to use a restraining system to hold a subject's hands together. When using the restraining systems disclosed in the prior art, three or four arresting officers must use overpowering force to put a handcuff or restraining system on a resisting subject.

The restraint devices of U.S. Pat. No. 539,650 issued to Searle May 1895 and U.S. Pat. No. 5,581,856 issued to Miller et al December 1996 contain locking clips which are permanently attached to straps or chains but are slidable to different lengths to tie down a subject. These locking clips may not be detached from the restraint device and are necessary for the operation of the restraint device.

U.S. Pat. No. 372,510 issued to Bean November 1887 teaches handcuffs comprising a central holder having two conventional key lock pawl mechanisms having ratchet teeth for one-way clutch engagement with two restraint members, spacers within the housing for engaging the key lock pawl mechanisms, and coil springs for biasing the key pawl into engagement with the restraint members, which key lock pawl mechanisms are interrelated such that a single key operation releases both sets of ratchets and pawls to open the handcuffs.

The device in U.S. Pat. No. 6,026,661 issued to Spiropoulus February 2000 allows the arresting officers to put handcuffs on the subject with ease, but they have to use force by using a ratcheting mechanism similar in design to a fishing reel. Such mechanism allows the arresting officers to, in effect, "reel in" each restraint until such restraints are brought together in a close relationship. This is a better device than the fixed-length handcuffs, but when the subject resists, the ratcheting mechanical reel device could become a dangerous weapon as the subject could swing it at the arresting officers.

U.S. Pat. No. 4,024,736 issued to De Michieli May 1977 describes a restraining mechanism which allows the subject to walk, but not run due to a one-way speed limiting locking mechanism. Walking speeds up to 350 feet per minute are allowed. The De Michieli device would not be suitable for use as handcuffs. The system of the De Michieli patent is not intended to be useful for constraining a resisting subject.

U.S. Pat. No. 6,360,747B1 issued to Velarde et al March 2002 shows a restraining system which comprises handcuffs and leg shackles. The overall length of the restraining system can be adjusted between a tight position to constrain a violent subject and a loose position which allows the subject to walk with difficulty. In this system, the distance between the handcuffs is always constant.

BRIEF SUMMARY OF THE INVENTION

The present invention solves the above-noted problems by providing restraining devices which have an adjustable distance between the bracelets of the devices.

In using the system of the Spiropoulus invention, the authority must take an active role in bringing the subject's hands together. In the present invention, the bracelets are brought together automatically whenever the subject decreases the distance between the bracelets. The distance will never increase. No force by an authority is required.

In use, the system of De Michieli will retract and lengthen. The locking mechanism will engage only if the subject is traveling at a rate of speed of greater than 350 feet per minute. In the present invention, the bracelets may move closer together but will not move farther apart.

The bracelets of the handcuffs or shackles may be applied to the subject while the subject's hands or feet are far apart and will retract automatically to a predetermined distance. Thus, the arresting officer does not need to have the hands of the subject together in order to apply the restraint devices. In the present invention the restraint devices maintain the bracelets locked while the bracelets are retracting, thus providing a continual limiting of movement of the subject while the subject is securely locked.

This invention is designed to help the arresting officer. When the subject resists arrest, this restraining device gives the officer the freedom of not having to force the subject's hands together to put the restraining device onto the subject. The restraint device is not fixed in length. Rather, it may become any length which is required and it may retract to a predetermined size. The first advantage of this restraint device over the prior art is that it may become any length by merely opening the device's bracelet on the central holder without a key.

The second advantage is that a retracting device retracts one of the bracelets automatically to the original position once the restraint device is on the subject.

The third advantage is that the distance between the bracelets may not increase, but may only decrease.

The fourth advantage is that when one bracelet is on the subject, the arresting officer can stay away from a dangerous subject and lock the other bracelet to any anchored place to restrain the subject. This is made possible by an automatic retraction/extension length-control feature of the restraint devices.

A fifth advantage of the present system over the prior art systems is that shackles of the present invention may be used as leg cuff to allow the subject to walk or run with officer, with the use of a line stopper. The sixth advantage is, in the event the subject runs, the line stopper may be detached and the shackles will go into their automatic retraction mode. In this event, the bracelets of the shackles will be drawn closer together but will never get farther apart. Thus, the subject cannot escape.

The restraining system of this invention is made up of a first bracelet with central holder having a retraction/extension mechanism, and a second bracelet attached by a line/strap to the retraction/extension mechanism. A line/strap stopper may be attached to the line to allow supervised freedom of movement.

The restraining system of the first embodiment of the invention is preferably made up of a first bracelet with central holder, and a second bracelet. The upper section of the first bracelet contains ratchets which mesh with corresponding pawls of a locking/unlocking mechanism located in the central holder to allow the upper section to travel downwardly in a tightening direction, but do not allow the upper section to travel upwardly in a loosening direction. The bracelet also contains a press mechanism which, when the bracelet is locked, it will press the one-way locking mechanism. The one-way locking mechanism engages and disengages with the retraction/extension mechanism, which has line/strap attached to and a line/strap which is attached to the second bracelet. When the first bracelet is closed, gears of the one-way locking mechanism and the retraction/extension mechanism are engaged, the retraction/extension mechanism allows the line to be retracted, but not extended.

The restraint devices of the second embodiment, like those of the first embodiment, are made up of a first bracelet with central holder, and a second bracelet. The upper section of the first bracelet contains ratchets which mesh with corresponding pawls of a locking/unlocking mechanism located in the central holder to allow the upper section of the first bracelet to travel downwardly in a tightening direction, but do not allow the upper section to travel upwardly in a loosening direction. The retraction/extension mechanism has line/strap attached to and a line which is attached to the second bracelet. When the ratchet of the bracelet and the retraction/extension mechanism are engaged, the retraction/extension mechanism allows the line to be retracted, but not extended.

DETAILED DESCRIPTION OF THE INVENTION

Figure 1:
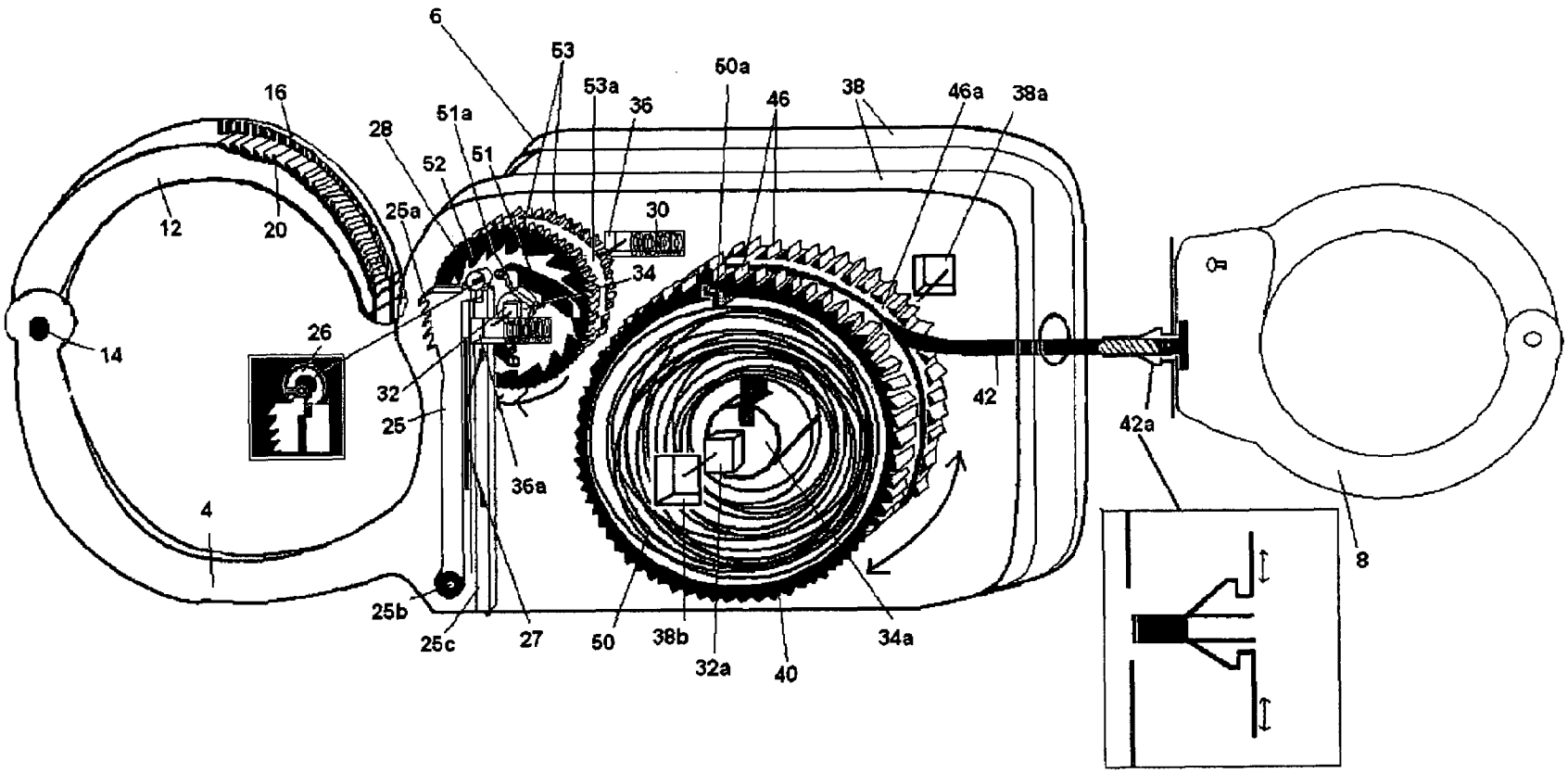
FIG. 1 is a front elevational perspective view in cut-away of the set of handcuffs of the first embodiment of the present invention in the opened mode with the line/strap retracted.

The first embodiment of this invention will be described with reference to FIG. 1.

The restraining system 2 is made up of a first bracelet 4 having a press mechanism 16 on the left; a central holder 6 having a one-way locking mechanism 28, a retraction/extension mechanism 40, and a line 42 attached to the retraction/extension mechanism 40; and a second bracelet 8 on the right.

The restraining system 2 is preferably made up of a first bracelet 4 with central holder 6 and a second bracelet 8. The central holder 6 has a one-way locking mechanism 28 and a retraction/extension mechanism 40. The one-way locking mechanism 28 and the retraction/extension mechanism 40 are engaged and disengaged by a press mechanism 16 which is part of the first bracelet 4.

The upper section 12 of the first bracelet 4 has a press mechanism 16 and a set of ratchets 20. FIG. 1 shows the ratchets 20 of the upper section 12 of the bracelet 4 disengaged from the pawls 25*a* of the locking/unlocking mechanism 25. When this is the case, the press mechanism 16 does not press against the one-way locking mechanism 28 which, in turn, does not engage with the retraction/extension mechanism 40. When this is the case, the line 42 may retract and extend. When the upper section 12 of the bracelet 4 is closed, the press mechanism 16 presses against press area 53*a* of the one-way locking mechanism 28 to cause it to be in contact with the retraction/extension mechanism 40. When this is the case, the line 42 may retract but may not extend.

When the first bracelet 4 is not attached to a subject, the first bracelet 4 may be pushed downward around the connection pivot pin 14 without using a key. This movement disengages the ratchets 20 of the first bracelet 4 from the pawls 25*a* of the locking/unlocking mechanism 25 and the gears 53 of the one-way locking mechanism 28 from the gears 46 of the retraction/extension mechanism 40, thus allowing both retraction and extension of the line 42 which holds the second bracelet 8.

The upper section 12 of the bracelet 4 is brought down so that the ratchets 20 engage with the pawls 25*a* of the locking/unlocking mechanism 25. The locking/unlocking mechanism 25 is pivoted about a pivot member 25*b* which is attached to the cover plate 38. A spring 27 push the locking/unlocking device 25 toward the left, which is the locked position.

When the ratchets 20 of the upper section 12 of the first bracelet 4 are engaged with the pawls 25*a* of the locking/unlocking mechanism 25, the first bracelet 4 is locked and cannot be opened without a key when it is on a subject. A key fits into the keyhole 26 and, when key is turned in the counterclockwise direction, the locking/unlocking mechanism 25 is moved to the right, thereby releasing the pawls 25*a* from the ratchets 20 to unlock the restraint device 2. When the ratchets 20 of the upper section 12 of the bracelet 4 are engaged with the pawls 25*a* of the locking/unlocking mechanism 25, the upper section 12 of the bracelet 4 can move only downwardly to tighten the bracelet 4 and cannot move upwardly.

The one-way locking mechanism 28 has gears 53 all the way around the two outer edges of the one-way locking mechanism 28. There is an open central press area 53*a* between these two outer edges. The gears 53 will engage with the gears 46 of the retraction/extension mechanism 40.

The one-way locking mechanism 28 contains a one-way locking device 51 inside. The one-way locking device 51 is attached with spring 51*a* which pull one way locking device 51 to have constant contact with inner ratchet of one way locking mechanism, which is supported by a shaft 34 having square ends 32 which fit into a grooved area 36 inside the cover plate 38 as is shown in FIG. 1. The shaft's 34 square ends 32 are pressed away from the retraction/extension mechanism 40 by compression springs 30 or any other type of springs when the press mechanism 16 is disengaged from the central press area 53*a* of the one-way locking mechanism 28.

The retraction/extension mechanism 40 contains a shaft 34*a* having square ends 32*a*. The cover plates 38 of the central holder 6 contain square holes 38*a*, 38*b* which hold the square ends 32*a* of the shaft 34*a* immovably in place.

One end of a coiled spring 50 is attached to the shaft 34*a* and the other end is attached to a slot 50*a* in the outer rim of the retraction/extension mechanism 40. As the line 42 is extended, tension is developed in the spring 50 which creates a force which will retract the line 42

When the press mechanism 16 is not pushing the one-way locking mechanism 28 to be engaged with retraction/extension unit 40, there is a space between the press mechanism 16 and the one-way locking mechanism 28. Also, there is a space between the one-way locking mechanism 28 and the retraction/extension mechanism 40. Since nothing is holding the retraction/extension mechanism 40, the line 42 holding the second bracelet 8 can retract and extend.

When the press mechanism 16 is pushing the one-way locking mechanism 28 to the right, the shaft 34*a*, which is slidably held in the groove area 36 of the cover plate 38 and which is push to the left by the spring 30, is moved to the right. As the one-way locking mechanism 28 is moved to the right, the gears 53 of the one-way locking mechanism 28 are engaged with the gears 46 of the retraction/extension mechanism 40, and the retraction/extension mechanism 40 will retract but not extend.

The restraint devices 3 of the second embodiment will be described with reference to FIGS. 2 and 3.

The restraint devices 3 of the second embodiment have the same working principle as those of the first embodiment and are made up of a first bracelet 54 with the central holder 56 and a second bracelet 58 on the right side of the central holder 56. The restraint devices 3 of the second embodiment do not use the one-way locking mechanism 28 (FIG. 1) of the first embodiment.

Figure 2:
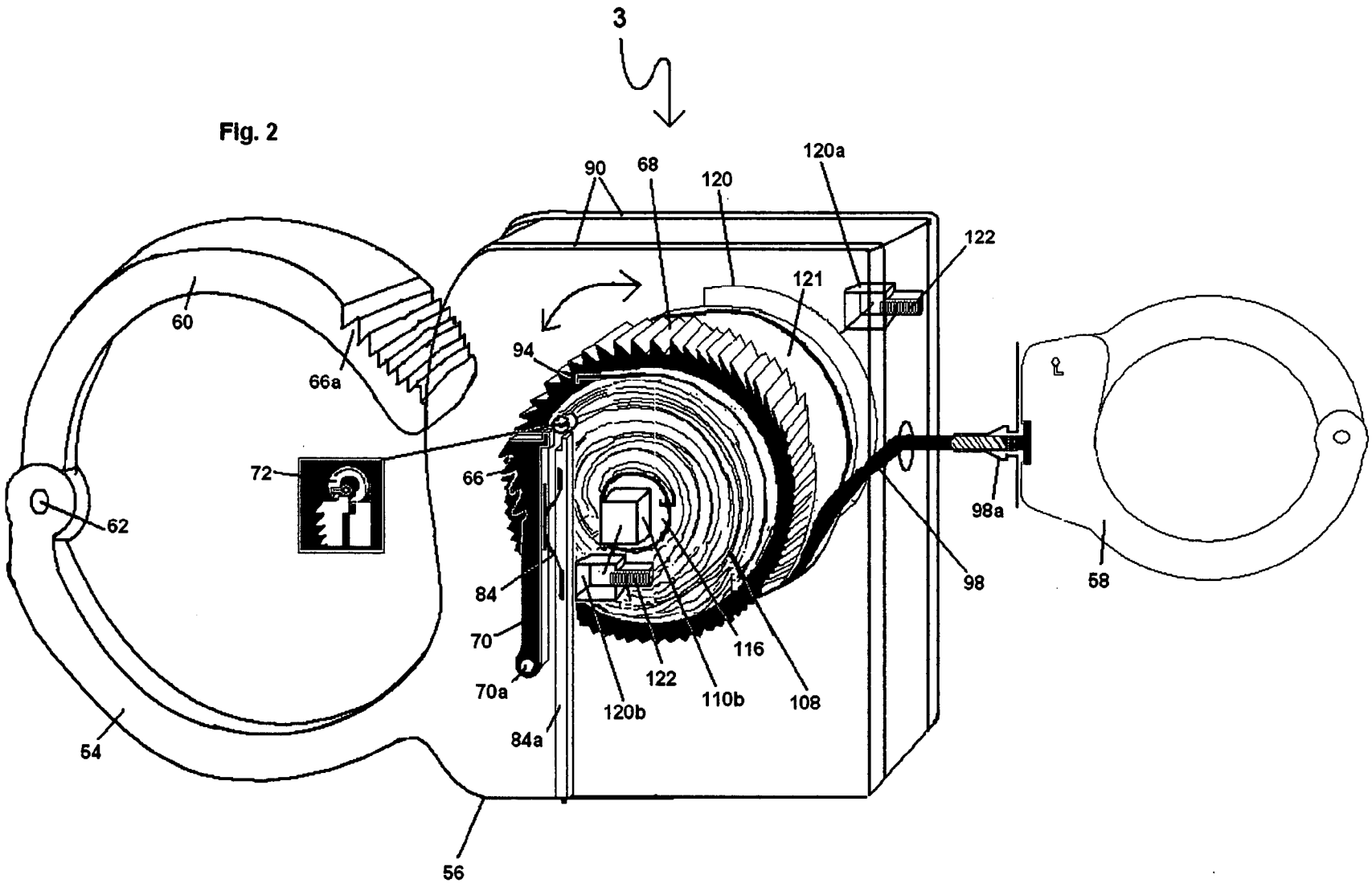
FIG. 2 is a front elevational perspective view in cut-away of the set of handcuffs of the second embodiment of the present invention with the first bracelet open and the line/strap retracted.

FIG. 2 shows the upper section 60 of the bracelet 54 having ratchets 66*a* which is attach by pivot pin 62. The upper section 60 of the bracelet 54 is brought down so that the ratchets 66*a* engage with the pawls 66 of the locking/unlocking mechanism 70. The locking/unlocking mechanism 70 is pivoted about a pivot member 70*a* which is attached to the cover plate 90. A spring 84 push the locking/unlocking mechanism 70 toward the left, which is the locked position.

When the ratchets 66*a* of the upper section 60 of the first bracelet 54 are engaged with the pawls 66 of the locking/unlocking mechanism 70, the first bracelet 54 is locked and cannot be opened without a key when it is on a subject. A key fits into the keyhole 72 and, when key is turned in the counterclockwise direction, the locking/unlocking mechanism 70 is moved to the right, thereby releasing the pawls 66 from the ratchets 66*a* to unlock the restraint device 3. When key is turned in the clock wise direction it will push down double locking mechanism 84*a* to leave space between locking/unlocking mechanism 70 and double locking mechanism 84 in order to locking/unlocking mechanism 70 to be move to right by a key. When the ratchets 66*a* of the upper section 60 of the bracelet 54 are engaged with the pawls 66 of the locking/unlocking mechanism 70, the upper section 60 of the bracelet 54 can move only downwardly to tighten the bracelet 54 and cannot move upwardly.

The locking/unlocking mechanism 70 is push to the left into the engagement position by a spring 84 located in a double locking mechanism 84*a*. The double locking mechanism 84*a* is placed in grooved area inside cover plate 90

When the ratchets 66*a* of the upper section 60 of the bracelet 54 engage with the pawls 66 of the locking/unlocking mechanism 70, the ratchets 66*a* also engage with the pawls 68 of the retraction/extension mechanism 120 and prevent the retraction/extension mechanism 120 from turning in a counterclockwise direction. In this condition the retraction/extension mechanism 120 may turn in a clockwise direction. The line/strap 98 is attached to the retraction/extension mechanism 120 that when the retraction/extension mechanism 120 turns in a clockwise direction the line 98 is retracted and when the retraction/extension mechanism 120 turns in a counterclockwise direction the line/strap 98 is extended.

Figure 3:
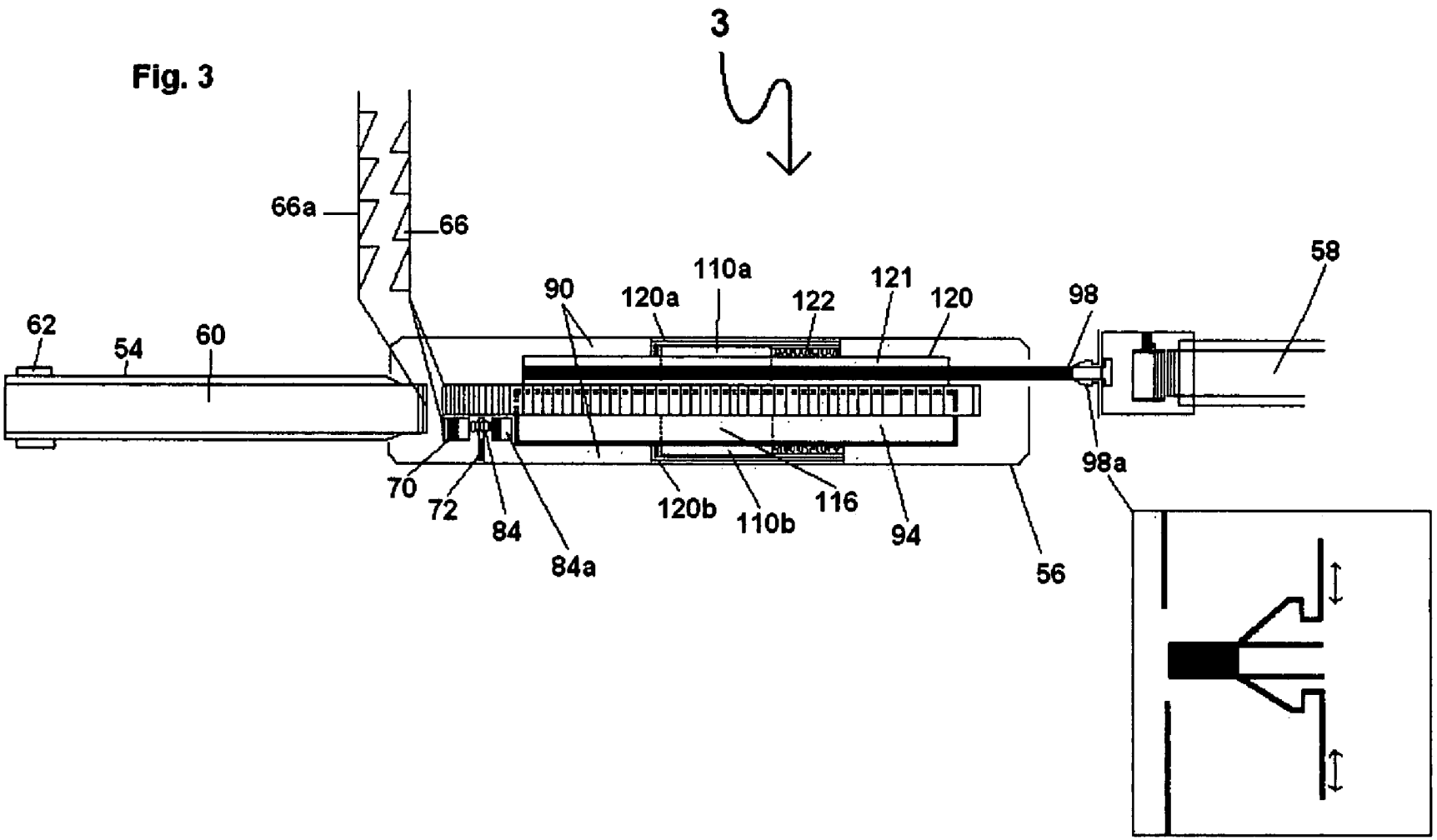
FIG. 3 is a top elevational view in cut-away of the set of handcuffs of the second embodiment of the present invention in open mode with the line/strap retracted.

FIGS. 2 and 3 show the retraction/extension mechanism 120 having a central shaft 116. One end of a coil spring 108 is attached to the shaft 116. The other end of the coil spring 108 is attached to the rim 94 of the retraction/extension mechanism 120 which may freely rotate about the shaft 116.

One end of the line 98 is attached to the attach area for line/strap 121 of the retraction/extension mechanism 120 and the other end is attached to the second bracelet 58. The retraction/extension mechanism 120 contains a shaft 116 having square ends 110*a*, 110*b*. The square ends 110*a*, 110*b* of the shaft 116 fit into grooves 120*a*, 120*b* in the cover plate 90. The square ends 110*a*, 110*b* of the shaft 116 may slide along the grooves 120*a*, 120*b* so that when the shaft 116 is located in the left ends of the grooves 120*a*, 120*b*, the pawls 68 of the retraction/extension mechanism 120 do not engage with the ratchets 66*a* of the upper section 60 of the first bracelet 54 as the first bracelet 54 is in the open position and when the shaft 116 is located in the right ends of the grooves 120*a*, 120*b*, the pawls 68 of the retraction/extension mechanism 120 are engaged with the ratchets 66*a* of the upper section 60 of the first bracelet 54 as the first bracelet 54 is closed. Springs 122 in the grooves 120*a*, 120*b* press upon the square ends 110*a*, 110*b* of the shaft 116 in order to push the retraction/extension mechanism 120 to the left.

As seen in FIGS. 1-3, the line 42, 98 is attached to the second bracelet 58 with the help of a clip device 42*a*, 98*a*. The clip device 42*a*, 98*a* allows for retention of the second bracelet 58 in the central holder 6, 56. Hand pressure on the ends of the clip device 42*a*, 98*a* allows for the release of the second bracelet 58 from the central holder 6, 56. Thus, the restraint device 2, 3 may be readily alternated between a restraint device 2, 3 having the second bracelet 58 secured directly to the central holder 56 and a restraint device 2, 3 having the second bracelet 58 attached to the central holder 56 by a line 42, 98 which may be extended or retracted.

Figure 4:
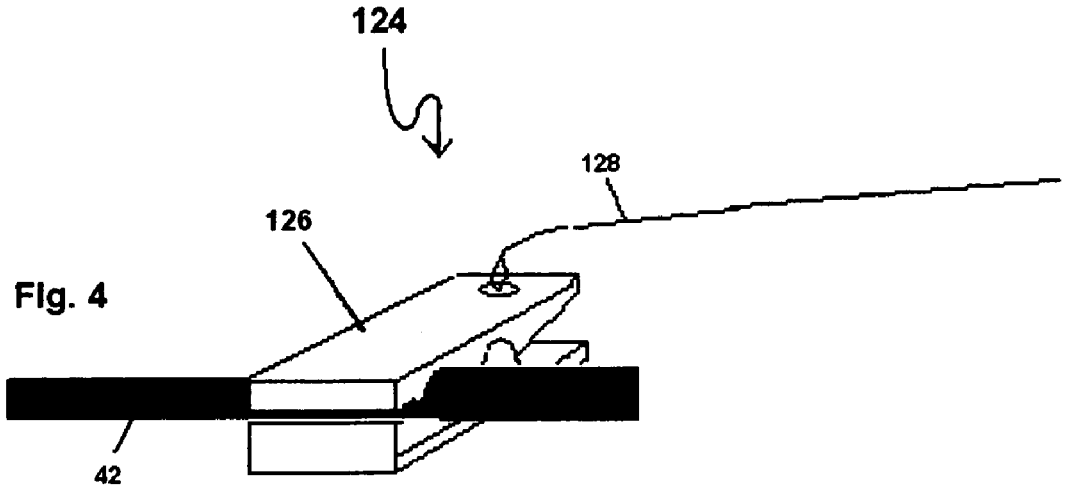
FIG. 4 is a front elevational view showing detail of the line/strap stopper with the attachment piece closed about a line/strap.
Figure 5:
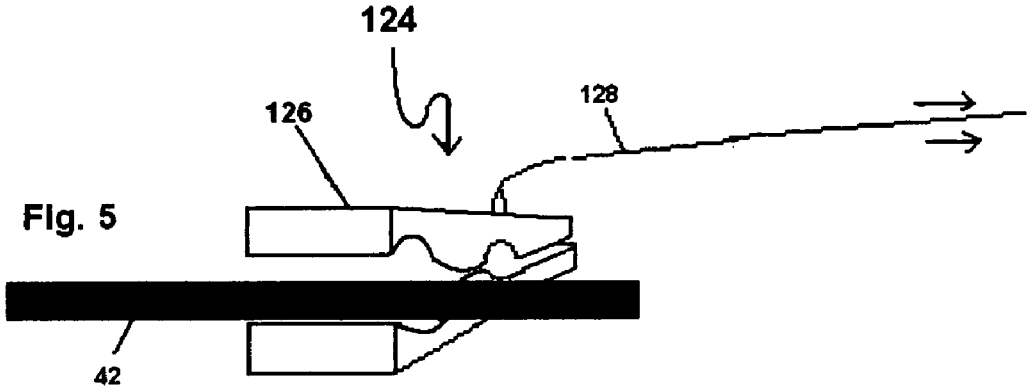
FIG. 5 is a front elevational view showing detail of the line stopper with the attachment piece open.

FIGS. 4 and 5 show the attachable/detachable line stopper 124. In FIG. 4 the attachment piece 126 is attached to a line 42, 98 and in FIG. 5 the attachment piece 126 has been opened by pulling on the control line 128. In use, the attachable/detachable line stopper 124 creates tension on the line 42, 98 between the retraction/extension mechanism 40, 120 and the second bracelet 8, 58 and prevents retraction of the second bracelet 8, 58. Alternatively, the line stopper 124 may be positioned any where as needed to prevent the line 42, 98 from being retracted into the central holder 6, 56.

Figure 6:
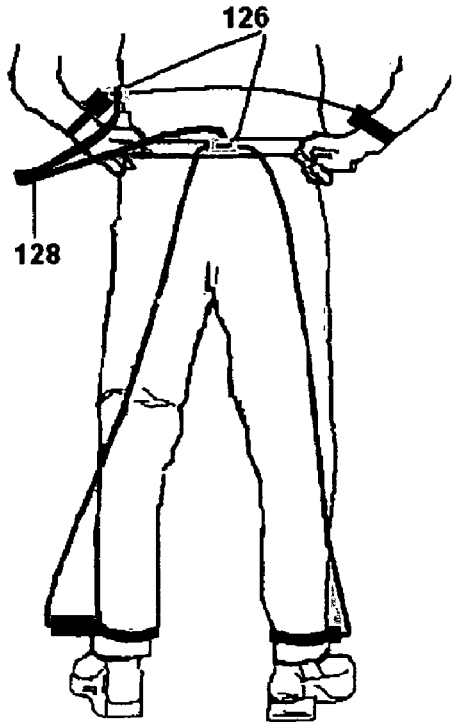
FIG. 6 is a rear elevational view of a subject having shackles and handcuffs according to the present invention wherein a line/strap stopper is attached to a line/strap.

The use of the attachable/detachable line stopper 124 will be described with reference to FIG. 6. When necessary, the control line 128 may be pulled to easily remove the attachment piece 126 from the line 42, 98 and allow the retraction of the bracelet 8,58. Thus, with the line stopper 124 attached to the line 42, 98, the subject is able to walk, jog, or run to safety in case of an emergency in the control of the authority. If the subject is trying to run away from the authority, the control line 128 may be pulled and the retraction mode of the restraint device 2, 3 will be activated.

Figure 7:
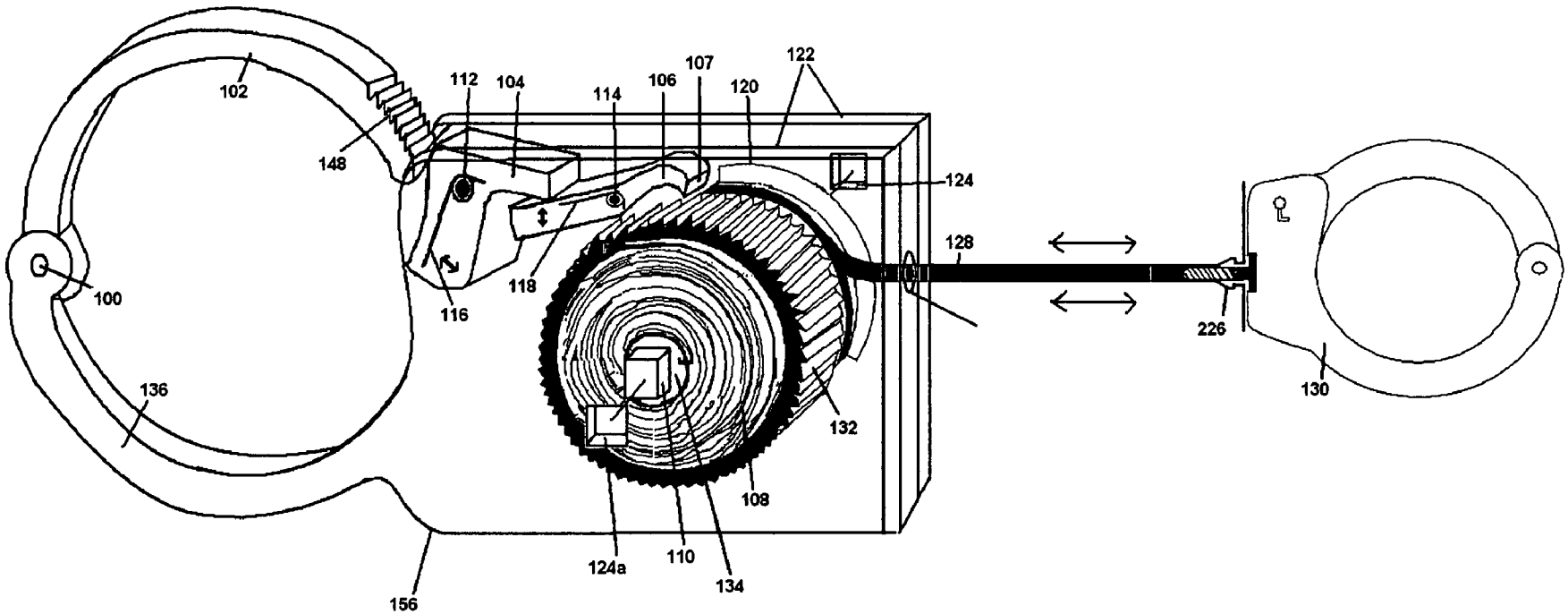
FIG. 7 is a frontal view of the clutch-less handcuff in the open position.

The restraining device 4 of the third embodiment will be described with reference to FIGS. 7 and 8. The restraint device 4 of the third embodiment, have the same working principle as those of the first and second embodiment and are made up of first bracelet 136 with central holder 156 and second bracelet 130 on the right side of the central holder 156. The restraint device 4 of the third embodiment do not use the one way locking unit 28 (in FIG. 1) of the first embodiment and spring unit 122 (FIG. 2) of the second embodiment, FIG. 7 shows the upper section 102 of the bracelet 136 having ratchets 148 is attached by pivot pin 100. When upper section 102 of the bracelet 136 is open as shown in (FIG. 7), ratchet 148 is not pressing the press lever mechanism 104 which put pressure to one way locking device 106 to be in not engaged with retractable/extendable unit 120 gears 132. In this mode second bracelet 130 can be extend or retract as needed.

The press lever 104 has pivot pin 112 attached to cover plate 122 and has spring 116, which press down one way locking device 106 in order to be, not engage with gear 132. One way locking device 106 has pivot pin 114 attached to cover plate 122 and has spring 118, which press pawl 107 to gear 132. Spring 116 has stronger force than spring 118. Since spring 116 is stronger, spring 118 is push back leaving space between pawl 107 and retractable/extendable unit's 120 gears 132.

Figure 8:
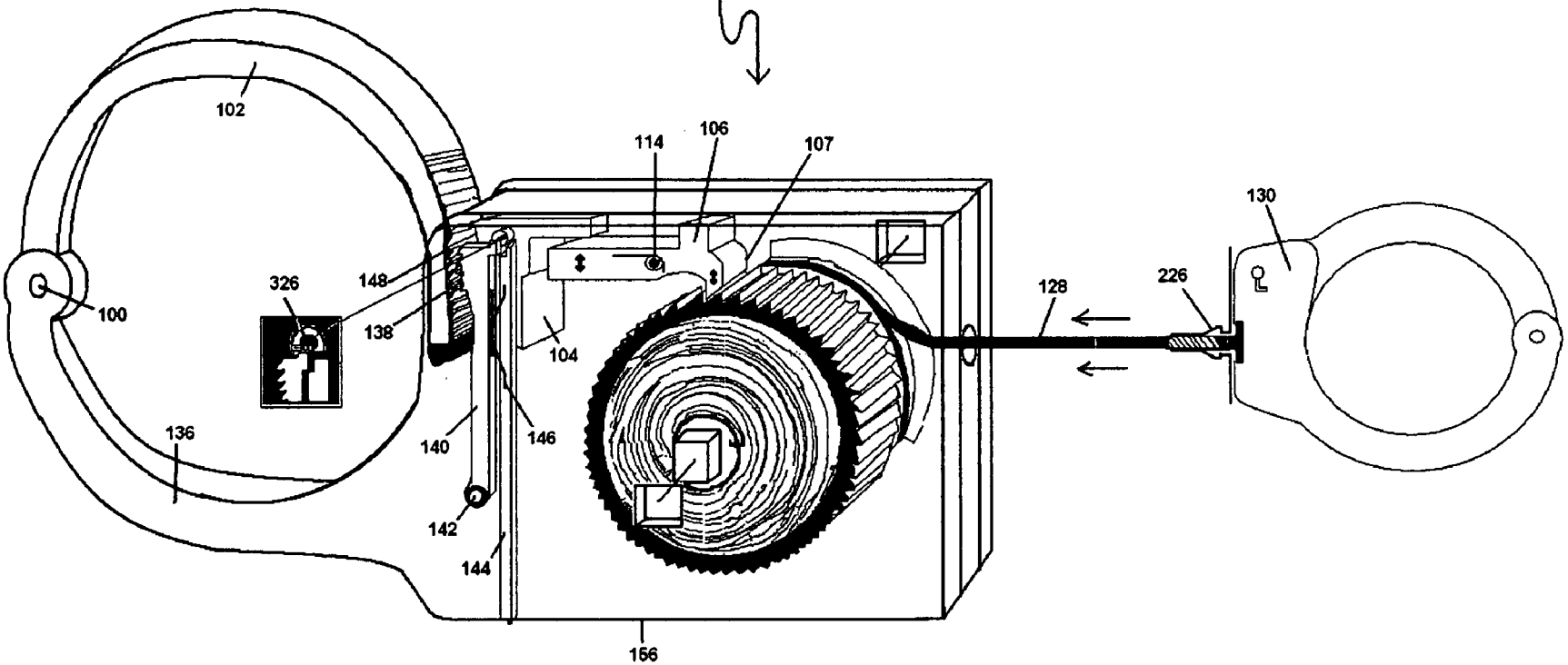
FIG. 8 is a frontal view of the clutch-less handcuff in the closed position.

Once upper section 102 of the bracelet 136 is closed as shown in (FIG. 8). Upper section 102 of the bracelet 136 ratchet 148 is lock with locking mechanism's 140 pawl 138. In this condition, the upper unit 120 cannot be open without key. Same time upper section's 102 ratchet 148 is pressing the press lever device 104, in order to, not press the one way locking device 106, one way locking device 106 is pivot 114 to cover plate 122 and spring 118 is pushing left up and right side down to be engaged with retractable/extendable unit 120. In this condition, retractable/extendable unit 120 will only allow retraction of line/strap 128 into central unit 156, also pulls the second bracelet 130 since it is attached to line/strap 128. Key hole 326 and locking/unlocking mechanism 140 with spring 146, double locking mechanism 144, pivot 142 operation are same way as first embodiment and second embodiment. Details of locking/unlocking key operation are explained in paragraph [0042]. Also first and second embodiment explained the operation of spring 108, shaft 134, shaft's holding area 110, grooved area 124, 124*a*, in cover plat 122, line/strap 128, second bracelet holder 226. Although the invention has been described and illustrated in detail, it is to be clearly understood that the same is by way of illustration and example, and is not to be taken by way of limitation. The spirit and scope of the present invention are to be limited only by the terms of the appended claims.

The invention claimed is:

1. A restraint device comprising a first bracelet having a pivot and an upper section having a series of ratchets at an end thereof which is opposite the pivot; a central holder; and a second bracelet, wherein the central holder contains a locking/unlocking mechanism having pawls which interlock with the ratchets of the first bracelet, a pivotable press lever mechanism having a first side which abuts with the first bracelet's ratchets, a pivotable one-way locking mechanism having a pawl, and a retraction/extension mechanism having gears and a first end of a line having first and second ends operatively attached thereto, wherein the second end of the line is operatively attached to the second bracelet, and wherein the parts are so arranged that (1) when the first bracelet is open the ratchets of the first bracelet do not operatively engage with the pawls of the locking/unlocking mechanism and the ratchets of the first bracelet do not urge the press lever mechanism, the press lever mechanism pivots in response to a spring action to press downwardly on the one-way locking mechanism to cause the one-way locking mechanism to pivot and disengage the pawl of the one-way locking mechanism from the gears of the refraction/extension mechanism, and the retraction/extension mechanism may either retract or extend the line and (2) when the first bracelet is closed, the ratchets of the first bracelet operatively engage with the pawls of the locking/unlocking mechanism and the ratchets of the first bracelet urge the press lever mechanism, the press lever mechanism is pivoted away from the one-way locking mechanism, the one-way locking mechanism pivots by spring action so that the pawl of the one-way locking mechanism engages with the gears of the retraction/extension mechanism preventing extension of the line but allowing refraction of the line.

2. The restraint device of claim 1, wherein said second bracelet comprises a clip device securely fitted into the central holder, allowing the release of said second bracelet from the central holder.

3. The restraint device of claim 1, wherein said line is prevented from retracting by an attachable/detachable line stopper attached thereto.

4. The restraint device of claim 3 wherein said attachable/detachable line stopper contains a line which may be held by the authority.

* * * * *